US008823691B2

(12) United States Patent
Ochiai et al.

(10) Patent No.: US 8,823,691 B2
(45) Date of Patent: Sep. 2, 2014

(54) DISPLAY DEVICE

(75) Inventors: Takahiro Ochiai, Chiba (JP); Mitsuru Goto, Chiba (JP); Hiroyuki Higashijima, Konosu (JP); Yoshihiro Kotani, Chiba (JP); Shuuichirou Matsumoto, Mobara (JP)

(73) Assignee: Japan Display Inc., Tokyo (JP)

( * ) Notice: Subject to any disclaimer, the term of this patent is extended or adjusted under 35 U.S.C. 154(b) by 275 days.

(21) Appl. No.: 13/348,673

(22) Filed: Jan. 12, 2012

(65) Prior Publication Data

US 2012/0182279 A1 Jul. 19, 2012

(30) Foreign Application Priority Data

Jan. 18, 2011 (JP) ..... 2011-007901

(51) Int. Cl.
*G09G 5/00* (2006.01)

(52) U.S. Cl.
USPC ..... 345/209; 345/100; 345/212

(58) Field of Classification Search
None
See application file for complete search history.

(56) References Cited

U.S. PATENT DOCUMENTS 6,452,578 B1 * 9/2002 Ito et al. ..... 345/94
2006/0041805 A1 2/2006 Song
2007/0052568 A1 * 3/2007 Horibata ..... 341/144
2007/0052658 A1 * 3/2007 Kim ..... 345/100
2008/0218502 A1 * 9/2008 Lee et al. ..... 345/208
2009/0243974 A1 * 10/2009 Tanaka et al. ..... 345/58
2009/0290677 A1 * 11/2009 Otose et al. ..... 377/78
2009/0295784 A1 * 12/2009 Kwon et al. ..... 345/213
2011/0007061 A1 * 1/2011 Ochiai et al. ..... 345/212
2011/0157112 A1 * 6/2011 Shibata et al. ..... 345/205

FOREIGN PATENT DOCUMENTS

JP 2002-287701 10/2002
JP 2006-39542 2/2006

* cited by examiner

*Primary Examiner* — Sumati Lefkowitz
*Assistant Examiner* — Josemarie G Acha, III
(74) *Attorney, Agent, or Firm* — Antonelli, Terry, Stout & Kraus, LLP.

(57) ABSTRACT

A display device includes: plural pixel groups each including pixel circuits; plural scanning lines that are each connected to the pixel circuits included in any one of the pixel groups; a clock signal supply circuit that supplies a clock signal including a pulse signal; a shift register circuit that selectively transmits the pulse signal to the scanning lines in a predetermined order; and data signal lines that are connected to the pixel circuits and that supply a data signal to the pixel circuits included in the pixel group to be scanned. The period of the pulse signal supplied to some of the scanning lines is longer than the period of the pulse signal supplied to the other scanning lines, or the data signal is transmitted by the transistors included in the pixel circuits.

4 Claims, 8 Drawing Sheets

DISPLAY DEVICE

CROSS-REFERENCE TO RELATED APPLICATION

The present application claims priority from Japanese application JP2011-007901 filed on Jan. 18, 2011, the content of which is hereby incorporated by reference into this application.

BACKGROUND OF THE INVENTION

1. Field of the Invention

The present invention relates to a display device including plural pixel circuits.

2. Description of the Related Art

There are display devices including plural pixel circuits, each of which has a transistor, like liquid crystal display devices. For example, in display devices in which plural pixel circuits are arranged in a matrix shape, data signal lines are arranged to correspond to the columns of the pixel circuits and the pixel circuits are scanned in units of rows. A data signal indicating a gray level to be displayed by the pixel circuits to be scanned is input from the corresponding data signal line. The pixel circuits store the input data signal. A signal for selecting a row of the pixel circuits is output from a shift register circuit.

Here, the pixel circuits characteristics for storing the data signal may differ from each other due to a factor such as a difference in characteristic between the rows. Hereafter, a cause of the phenomenon in case of liquid crystal display device will be described. In the liquid crystal display device, the polarity of a voltage to be applied to liquid crystal is changed every predetermined time so as to prevent a ghost image. At this time, a method called N-line inversion may be used. In the method, the polarity of the data signal input to the data signal line changes whenever N rows are scanned. On the other hand, it is known that it takes a predetermined time for the potential of the pixel electrodes to vary to the potential of the data signal due to parasitic capacitance generated in the data signal lines and the like. The pixel electrodes apply a voltage to the liquid crystal. When the potential of the data signal greatly varies, it is difficult for the voltage applied to the liquid crystal to satisfactorily vary. In the N-line inversion, the variation in potential of the data signal when the polarity is changed is greater than the variation in potential of the data signal when the polarity is not changed. Thus there is a difference in the voltages applied to the liquid crystal between the row changed in polarity from the previous row and the row unchanged in polarity, thereby causing unevenness in brightness to be displayed.

JP2006-39542A discloses a display device that includes a dummy row in a shift register and that copes with the above-mentioned problem using an operation of scanning a dummy row. JP2002-287701A discloses a liquid crystal display device coping with the above-mentioned problem by changing the time of scanning rows by the use of a general shift register constructed in a driver IC.

SUMMARY OF THE INVENTION

A certain type of shift register circuit selects a row by transmitting a pulse signal supplied from the outside to pixel circuits to be scanned. For example, the select operation is performed in a period in which a group of pixel circuits such as a row of pixel circuits is scanned. The shift register circuit is formed, for example, in a glass substrate of a display device. This simple configuration obtains the suppression of the degradation in waveform due to the difference in characteristic between transistors. In the display device using such a shift register circuit, unevenness in brightness occurs when the characteristic of storing a data signal varies between the groups of pixel circuits.

An advantage of some aspects of the invention is that it provides a display device which can cope with the variation of the characteristic of storing a data signal according to groups of pixel circuits using a simpler configuration than the case not using the configuration of the present invention.

Representative configurations of the invention disclosed in this application will be described in brief as follows.

(1) According to an aspect of the invention, there is provided a display device including: plural pixel groups each including pixel circuits; plural scanning lines that are each disposed to correspond to any one of the pixel groups and that are connected to the pixel circuits included in the corresponding pixel group; a clock signal supply circuit that supplies a clock signal including a pulse signal as a potential scanning the corresponding pixel group in a period in which each of the pixel groups is scanned; a shift register circuit that selectively transmits the pulse signal to the scanning lines in a predetermined order; and data signal lines that are connected to the pixel circuits included in the pixel groups and that supply a data signal to the pixel circuits included in the pixel group to be scanned, wherein the clock signal supply circuit supplies the clock signal so that a period of the pulse signal supplied to some of the scanning lines is longer than a period of the pulse signal supplied to the other scanning lines.

(2) In the display device according to (1), the clock signal supply circuit supplies the clock signal so that the period of the pulse signal supplied to the pixel group to be scanned in a case that the polarity of the data signal supplied to the pixel circuits included in the pixel group to be scanned is different from the polarity of the data signal supplied to the pixel circuits included in the pixel group which is scanned just before the pixel group to be scanned is longer than a case in which the polarities of the two data signals are not different from each other.

(3) The display device according to (2) further includes plural clock signal lines that supply the clock signal from the clock signal supply circuit to the shift register circuit, the clock signal supply circuit repeatedly supplies the pulse signal to the clock signal lines sequentially from the first clock signal line, and the data signal lines supply the data signal changed in polarity every selection of predetermined number of the pixel groups, and the predetermined number of the pixel groups is any of divisors other than 1 of the number of clock signal lines.

(4) In the display device according to (3), the shift register circuit includes plural elementary circuits that transmit the pulse signal from the clock signal supply circuit to any of the scanning lines, each elementary circuit includes: a first transistor that is disposed between the clock signal line corresponding to the remainder when the ranking of the scanning line transmitting the pulse signal is divided by the number of clock signal lines and the corresponding scanning line; a second transistor that is diode-connected and that supplies the pulse signal to be output to the scanning line in a predetermined number before the scanning line to which the elementary circuit transmits the pulse signal to the gate electrode of the first transistor; a capacitor that stores a potential difference generated due to the potential of the pulse signal supplied from the second transistor and that turns on the first transistor until the potential difference is reset; and a third transistor that resets the potential difference stored in the capacitor on the basis of the pulse signal output to the scanning line in a predetermined number after the scanning line to which the elementary circuit transmits the pulse signal, and the width of the source electrode and the drain electrode of the second transistor included in the elementary circuit in which the period in which the supplied pulse signal serves as a scanning potential is long is smaller than the width of the source electrode and the drain electrode of the second transistor included in the other elementary circuit.

(5) According to another aspect of the invention, there is provided a display device including: plural pixel groups that each include plural pixel circuits; plural scanning lines that are each disposed to correspond to any one of the pixel groups and that are connected to the pixel circuits included in the corresponding pixel group; data signal lines that are connected to the pixel circuits included in each of the pixel groups and that supply a data signal to the pixel circuits; a clock signal supply circuit that supplies a clock signal including a pulse signal scanning each of the pixel groups; and a shift register circuit that selectively transmits the pulse signal to the scanning lines in a predetermined order, wherein each pixel circuit includes a pixel transistor that transmits the data signal when the pulse signal is supplied from the scanning line connected to the pixel circuit, and the clock signal supply circuit supplies the pulse signal so that transmissibility when the pixel transistors included in the pixel circuits included in some of the pixel groups transmit the data signal is greater than transmissibility when the pixel transistors included in the pixel circuits included in the other pixel groups transmit the data signal.

(6) In the display device according to (5), the pixel transistor included in each pixel circuit is an n-channel transistor, and the clock signal supply circuit supplies the pulse signal so that the maximum potential of the pulse signal supplied to the pixel circuits included in some of the pixel groups is higher than the maximum potential of the pulse signal supplied to the pixel circuits included in the other pixel groups.

(7) In the display device according to (5), the pixel transistor included in each pixel circuit is a p-channel transistor, and the clock signal supply circuit supplies the pulse signal so that the minimum potential of the pulse signal supplied to the pixel circuits included in some of the pixel groups is lower than the minimum potential of the pulse signal supplied to the pixel circuits included in the other pixel groups.

(8) In the display device according to (6) or (7), the clock signal supply circuit supplies the pulse signal of a predetermined potential in a predetermined last period of the period in which some of the plurality pixel groups and the other pixel groups are scanned.

(9) In the display device according to (8), the clock signal supply circuit supplies the clock signal so that transmissibility when the polarity of the data signal supplied to the pixel circuits included in the pixel group to be scanned is different from the polarity of the data signal supplied to the pixel circuits included in the pixel group which is scanned just before the pixel group to be scanned, the pixel transistors included in the pixel circuits included in the pixel group to be scanned transmit the data signal is greater than transmissibility when the polarities of the two data signals are not different from each other.

(10) The display device according to (9) further includes plural clock signal lines that supply the clock signal from the clock signal supply circuit to the shift register circuit, the clock signal supply circuit repeatedly supplies the pulse signal to the clock signal lines sequentially from the first clock signal line, and the data signal lines supply the data signal changed in polarity every selection of predetermined number of the pixel groups, and the predetermined number of the pixel groups is any of divisors other than 1 of the number of clock signal lines.

According to the invention, the display device can cope with the variation of storing a data signal according to groups of pixel circuits using a simpler configuration than the case not using the configuration of the present invention.

DETAILED DESCRIPTION OF THE INVENTION

Figure 1:
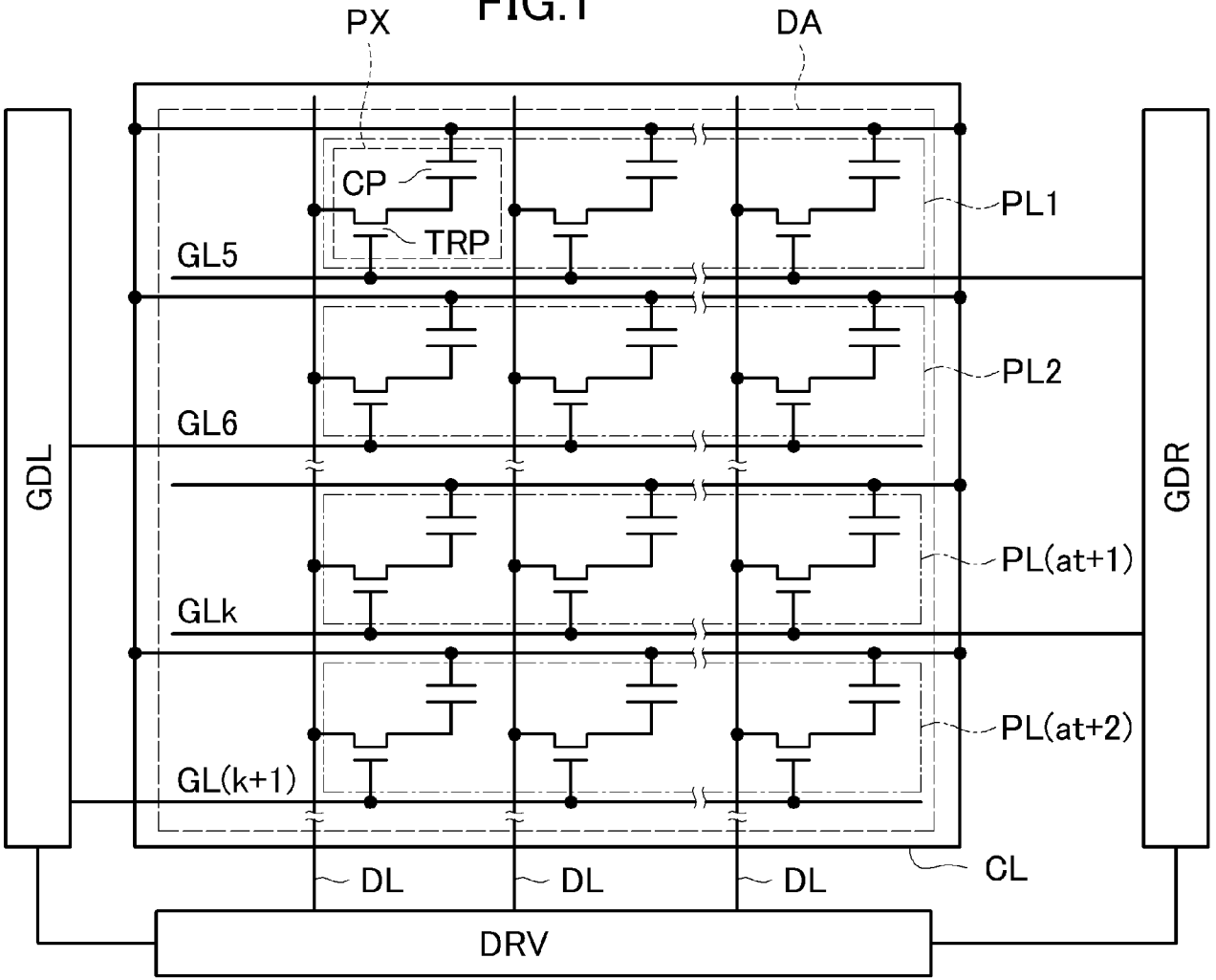
FIG. 1 is a circuit diagram illustrating an exemplary configuration of a liquid crystal display device according to a first embodiment of the invention.

Hereinafter, embodiments of the invention will be described with reference to the accompanying drawings. Elements having the same functions are reference by like reference characters and description thereof will not be repeated. An example of a liquid crystal display device as a kind of display device will be described below.

First Embodiment

A liquid crystal display device according to a first embodiment of the invention physically includes an array substrate, a counter substrate opposed to the array substrate, and a driver integrated circuit. Liquid crystal is enclosed between the counter substrate and the array substrate and the driver integrated circuit is disposed in a part on the array substrate not overlapping with the counter substrate. FIG. 1 is a circuit diagram illustrating an exemplary configuration of the liquid crystal display device according to the first embodiment of the invention. The circuit shown in the drawing is physically disposed in the array substrate and the driver integrated circuit.

The liquid crystal display device includes plural pixel circuits PX, plural gate signal lines GL (scanning lines), plural data signal lines DL, a common line CL connected to the pixel circuits PX, shift register circuits GDL and GDR, and a control circuit DRV. The pixel circuits PX are arranged in an N×M matrix in a display area DA on the array substrate. Each of the gate signal lines GL is arranged to correspond to one row of the pixel circuits PX. Each of the data signal lines DL is arranged to correspond to one column of the pixel circuits PX. Physically, the control circuit DRV is disposed in the driver integrated circuit and the pixel circuits PX, the data signal lines DL, the gate signal lines GL, the common line CL, and the shift register circuits GDL and GDR are disposed on the array substrate. The gate signal line GL is disposed for each row of the pixel circuits PX and the number of gate signal lines is N, except for dummy gate signal lines to be described later. The data signal line DL is disposed for each column of the pixel circuits PX and the number of data signal lines is M. Each pixel circuit PX is connected to the data signal line DL corresponding to the column of pixel circuits PX to which the pixel circuit PX belongs and the gate signal line GL corresponding to the row of pixel circuits PX to which the pixel circuit PX belongs. Hereinafter, each row of pixel circuit PX is referred to as a pixel line PL. The pixel line PL also serves as a group of pixel circuits PX (pixel group). The i-th pixel line PL from the top of the drawing is referred to as PLi and the gate signal line GL connected to the pixel circuits PX included in the i-th pixel line PLi is referred to as GL(i+4). GL1 to GL4 and GL(N+5) to GL(N+8) represent dummy gate signal lines GL not shown. M is a positive integer and N is a positive integer which is a multiple of 2. The reason why N is a multiple of 2 is that the number of shift register circuits GDL and GDR is 2: For example, when the resolution of the liquid crystal display area is a color display of 640 rows×480 columns and the pixel circuits PX displaying red, blue, and green are arranged in the column direction, N is 640 and M is 480×3.

Each pixel circuit PX includes a pixel transistor TRP and a pixel capacitor CP. The pixel capacitor CP is mainly formed between a common electrode which is a part of the common line CL and a pixel electrode PT opposed to the common electrode with the liquid crystal interposed therebetween. The pixel transistor TRP is an n-channel thin film transistor. The source electrode of the pixel transistor TRP is connected to the pixel electrode PT which is also an end of the pixel capacitor CP and the drain electrode of the pixel transistor TRP is connected to the data signal line DL connected to the pixel circuit PX. Here, the source electrode and the drain electrode of the thin film transistor have no polarity, and the source electrode and the drain electrode are names for convenience which are determined depending on whether the potential supplied to one is higher than the potential supplied to the other. Therefore, the points to which the source electrode and the drain electrode are connected may be inverted.

The control circuit DRV includes a clock signal supply circuit. The clock signal supply circuit supplies a clock signal to eight clock signal lines V1 to V8. Here, the clock signal includes a pulse signal having a potential for turning on the pixel transistors TRP and for scanning the pixel lines PL. In a period in which each of the pixel lines PL is scanned, the pulse signal is supplied to the pixel circuits PX included in the corresponding pixel line PL. In the example shown in FIG. 1, since the pixel transistor TRP is an n-channel type, a potential for turning on the pixel transistor TRP is higher than a potential for not turning on the transistor. The clock signal supply circuit supplies the pulse signal to the clock signal lines sequentially from the first clock signal line V1. When supplying the pulse signal to the final clock signal line V8, the clock signal supply circuit repeatedly supplies the pulse signal to the clock signal lines sequentially from the first clock signal line V1 again. The number of clock signal lines may not be eight, as long as it is four or more. The clock signal supply circuit supplies a start signal to start signal lines VST and VST2 in a predetermined period from the end of the supply of a data signal DAT to the pixel circuits PX in a frame to the start of the supply of the data signal DAT to the pixel circuits PX in the subsequent frame. The control circuit DRV is connected to the plural data signal lines DL and the control circuit DRV supplies the data signal DAT representing gray levels to be displayed by the pixel circuits PX to the data signal lines DL.

Figure 2:
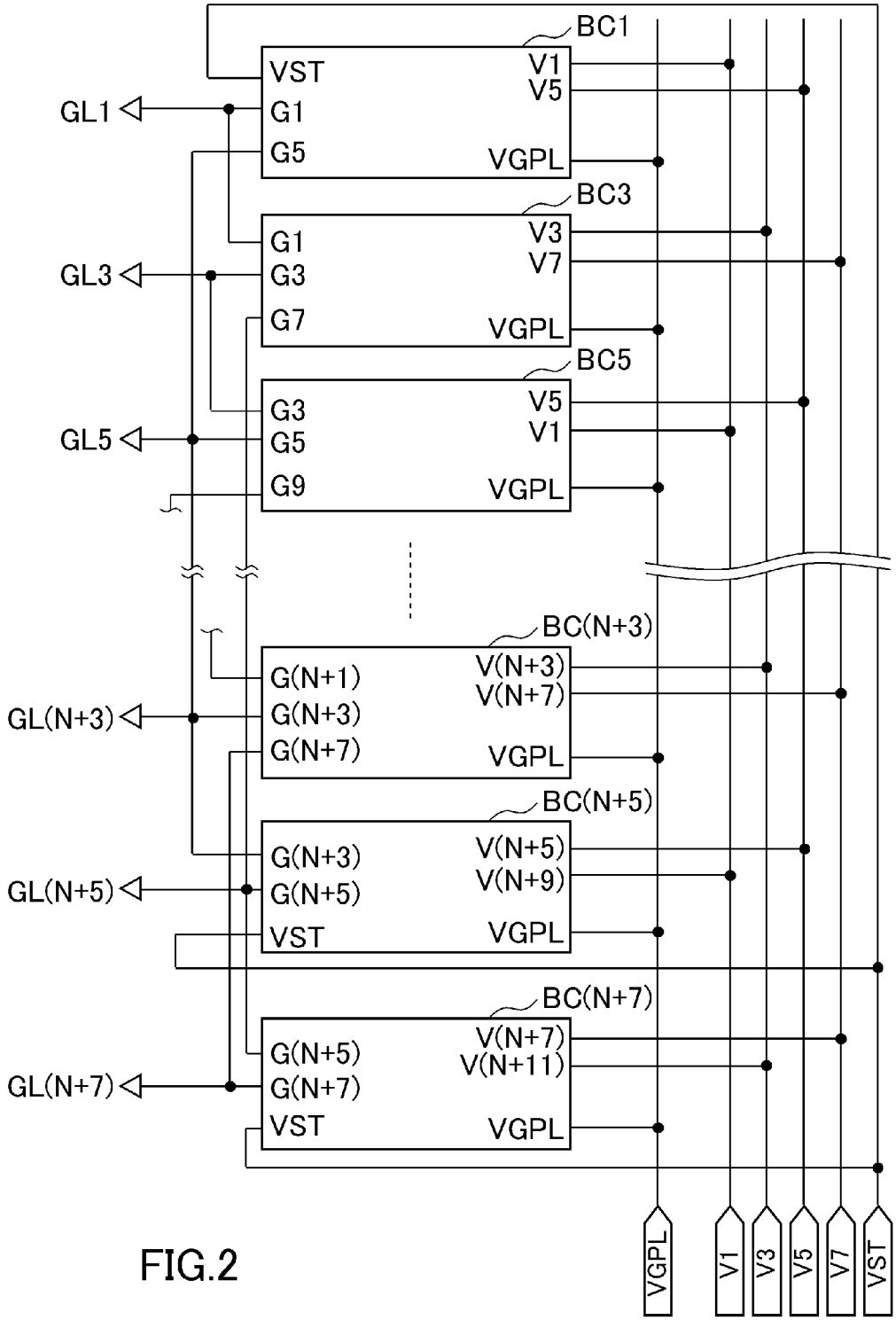
FIG. 2 is a diagram illustrating an exemplary configuration of a shift register circuit on the right side.

The shift register circuit GDL is disposed on the left side of the display area DA and the shift register circuit GDR is disposed on the right side of the display area DA. The right shift register circuit GDR is connected to the odd gate signal lines GL from the upside and the left shift register circuit GDL is connected to the even gate signal lines GL from the upside. FIG. 2 is a diagram illustrating an exemplary configuration of the right shift register circuit GDR. Each of the shift register circuits GDL and GDR includes (N/2+2) elementary circuits BC. Each elementary circuit BC includes five input terminals and one output terminal. The output terminals of the elementary circuits BC included in the shift register circuit GDR are connected to the gate signal lines GL1, GL3, GL5, . . . , GL(N+3), GL(N+5), and GL(N+7), respectively, and outputs signals to the connected gate signal lines GL. The shift register circuit GDR is supplied with signals from the start signal lines VST, the clock signal lines V1, V3, V5, and V7, and a reference potential supply line VGPL. The reference potential supply line VGPL supplies a reference potential to the fifth input terminal of each elementary circuit BC. Although not shown in the drawing, the output terminals of the elementary circuits BC included in the shift register circuit GDL are connected to the gate signal lines GL2, GL4, GL6, . . . , GL(N+4), GL(N+6), and GL(N+8), respectively, and outputs signals to the connected gate signal lines GL. The shift register circuit GDL is supplied with signals from the start signal line VST2, the clock signal lines V2, V4, V6, and V8, and the reference potential supply line VGPL. The elementary circuit BC outputting a signal to the gate signal line GLy (where y is an integer of from 1 to N+8) is referenced by BCy.

Out of the input and output terminals of the elementary circuits BC shown in FIG. 2 and the like, the terminal connected to the gate signal line GLy is referenced by Gy. The first to fourth input terminals of the elementary circuit BCn, of which the output terminal is connected to the n-th gate signal line GLn (where n is an integer of from 1 to N+8), are connected to the signal of the gate signal line GL(n−2) two gate signal lines before, the signal of the gate signal lines GL(n+4) four gate signal lines after, and two different clock signal lines respectively. Here, when n is less than 3, the elementary circuit is connected to the start signal line VST or the start signal line VST2 instead of the gate signal line GL two gate signal lines before. When n is greater than (N+4), the elementary circuit BCn is connected to the start signal line VST or the start signal line VST2 instead of the gate signal line GL four gate signal lines after. Two clock signal lines connected to the input terminals of the elementary circuit BCn is determined depending on the remainder when n is divided by the number of clock signal lines. Here, F(n) is defined by a function of feeding back 1 to 7 when the remainder in which n is divided by the number of clock signal lines is in the range of 1 to 7 and feeding back 8 when the remainder is 0. Two input terminals of the n-th elementary circuit BCn are connected to the F(n)-th clock signal line and the F(n+4)-th clock signal line. Here, whether the elementary circuit BCn is connected to the start signal line VST or the start signal line VST2 is determined depending on whether the elementary circuit BCn is included in the shift register circuit GDR or the shift register circuit GDL. The elementary circuit BCn included in the shift register circuit GDR is connected to the start signal line VST and the elementary circuit BCn included in the shift register circuit GDL is connected to the start signal line VST2. As a result, each of the shift register circuit GDL and the shift register circuit GDR are connected to a half of the clock signal lines. Vy in the elementary circuit BC shown in FIG. 2 represents the input terminal connected to the F(y)-th clock signal line.

Figure 3:
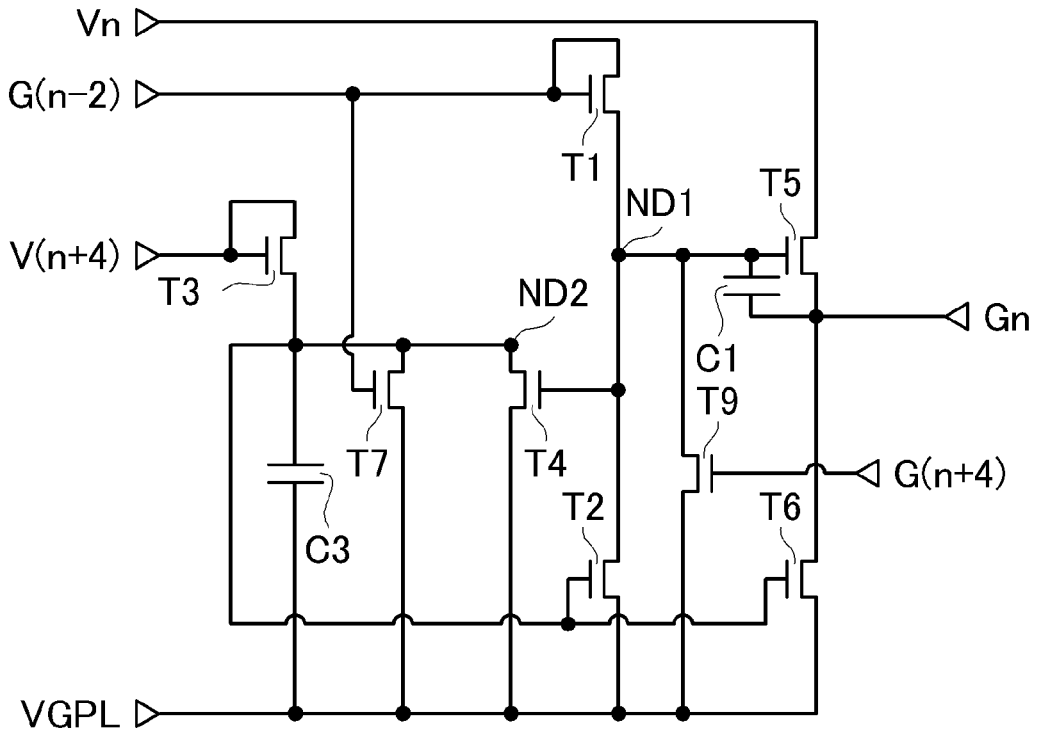
FIG. 3 is a circuit diagram illustrating an exemplary configuration of an elementary circuit.

FIG. 3 is a circuit diagram illustrating an exemplary configuration of the n-th elementary circuit BCn. Each elementary circuit BC includes transistors T1 to T7 and T9 and capacitors C1 and C3. The transistors T1 to T7 and T9 are n-channel thin film transistors. The drain electrode of the transistor T5 is connected to the input terminal Vn connected to the F(n)-th clock signal line. The source electrode of the transistor T5 is connected to the output terminal Gn connected to the gate signal line GLn. An end of the capacitor C1 is connected to the gate electrode of the transistor T5 and the other end thereof is connected to the source electrode of the transistor T5. The capacitor C1 stores a potential difference generated at both ends thereof, turns on the transistor T5 in the vicinity of outputting the pulse signal to the gate signal line GLn, and applies a bootstrap voltage to the gate electrode of the transistor T5 when supplying the potential of the pulse signal, thereby suppressing the deformation of the waveform. Here, the node of the gate electrode of the transistor T5 is referred to as a node ND1.

The transistor T1 is a transistor of which the gate electrode and the drain electrode are connected (so-called diode-connected), the gate electrode and the drain electrode thereof are connected to the input terminal G(n−2) to which the output of the elementary circuit BC(n−2) two elementary circuits before is input, and the source electrode of the transistor T1 is connected to the gate electrode of the transistor T5. The transistor T1 has a function of transmitting the pulse signal from the input terminal G(n−2) but preventing electric charges of the capacitor C1 from being discharged when the pulse signal is not supplied. The drain electrodes of the transistors T2 and T9 are connected to the gate electrode of the transistor T5 and the source electrodes of the transistors T2 and T9 are connected to the reference potential supply line VGPL. The gate electrode of the transistor T9 is connected to the input terminal G(n+4) to which the output of the elementary circuit BC(n+4) four elementary circuits after is input. The transistor T3 is a diode-connected transistor, the gate electrode and the drain electrode thereof are connected to the input terminal V(n+4) connected to the F(n+4)-th clock signal line, and the source electrode of the transistor T3 is connected to the gate electrode of the transistor T2. The node of the gate electrode of the transistor T2 is referred to as a node ND2. The source electrode of the transistor T3 is also connected to the gate electrode of the transistor T6. The drain electrode of the transistor T6 is connected to the output terminal Gn and the source electrode thereof is connected to the reference potential supply line VGPL. An end of the capacitor C3, the drain electrode of the transistor T7, and the drain electrode of the transistor T4 are connected to the source electrode of the transistor T3. The other end of the capacitor C3, the source electrode of the transistor T7, and the source electrode of the transistor T4 are connected to the reference potential supply line VGPL. The gate electrode of the transistor T7 is connected to the input terminal G(n−2) and the gate electrode of the transistor T4 is connected to the gate electrode of the transistor T5. In the elementary circuits BC1, BC2, and BC(N+5) to BC(N+8), some input terminals are connected to the start signal line VST or the start signal line VST2 instead of the gate signal lines GL.

Figure 4:
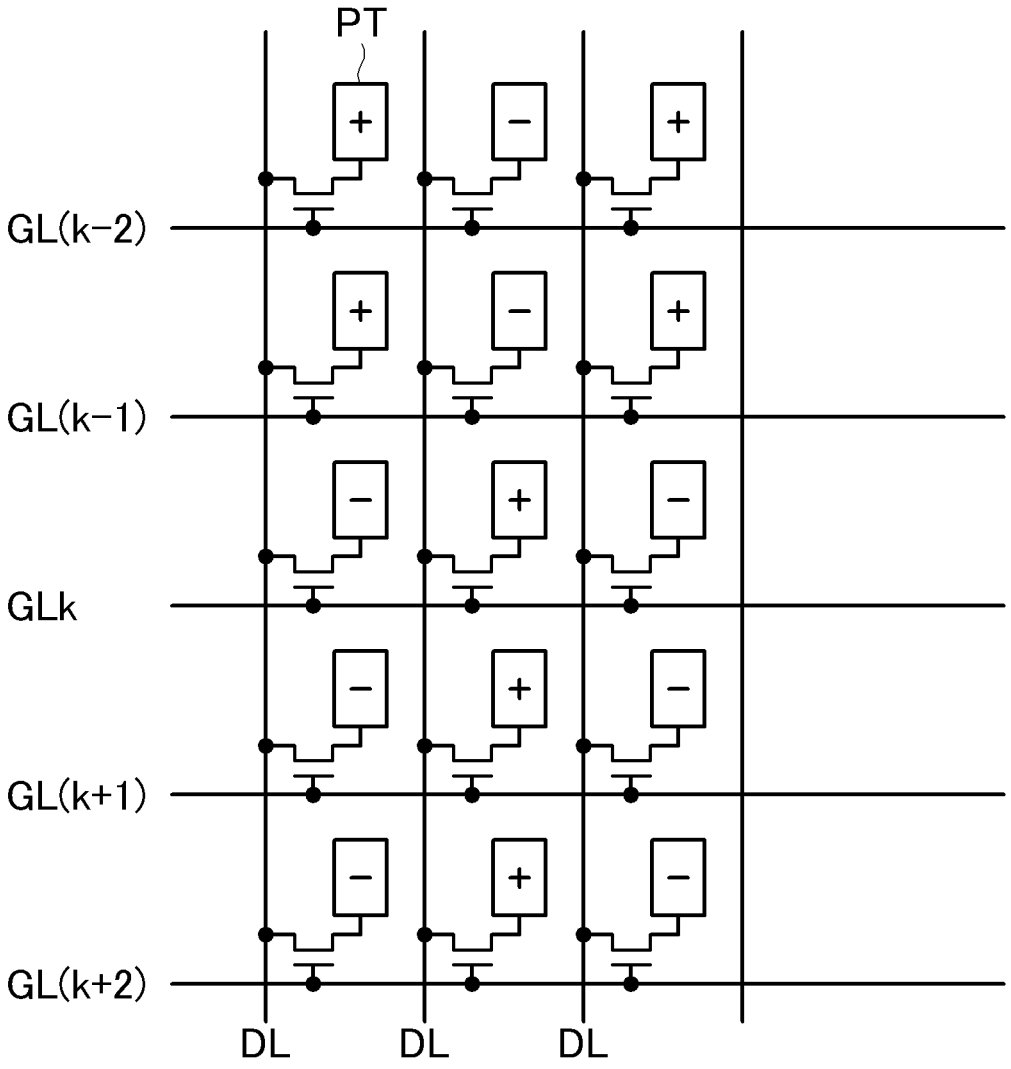
FIG. 4 is a diagram illustrating the examples of the polarities of data signals supplied to pixel circuits in N-dot inversion and N-line inversion.

The operations of the shift register circuits and the liquid crystal display device according to this embodiment will be described below. In this embodiment, a driving method of dot inversion and line inversion is used. FIG. 4 is a diagram illustrating examples of polarities of the data signals DAT supplied to the pixel circuits in the dot inversion and the line inversion. The line inversion means a method of inverting the polarity of the data signal DAT supplied to the pixel circuits PX whenever the pixel circuits PX are driven by A rows. The dot inversion means a method of inverting the polarity of the data signal DAT supplied to the pixel circuits every B columns. In the example shown in FIG. 4, A is set to 8 and B is set to 1. Here, when a pulse signal is supplied to a gate signal line GL, the pixel transistors TRP included in the pixel circuits PX connected to the gate signal line GL are turned on and the pixel transistors TRP transmit the data signal DAT from the data signal line DL to the pixel capacitors CP. This means that the pixel line PL corresponding to the gate signal line GL which is a supply target of the data signal DAT is scanned. In this liquid crystal display device, a potential difference representing the gray level to be displayed is stored in the pixel capacitor CP of each pixel circuit PX by supplying the data signal DAT to the pixel circuits PX included in each pixel line PL. Hereinafter, the storing of the potential difference is referred to as writing of the data signal DAT to the pixel circuit PX.

In this liquid crystal display device, the dot inversion is realized by inverting the polarity of the data signal DAT supplied to the data signal line DL every B columns. The line inversion is realized by inverting the polarity of the data signal DAT supplied to the data signal lines DL whenever the pixel circuits PX to which the data signal DAT is written is scanned by A rows. In the example shown in FIG. 4, when the pixel line PL corresponding to the (k−1)-th gate signal line GL(k−1) is scanned (where k is an integer of from 7 to N+2 and an integer of (a multiple of A)+5) and then the pixel line PL corresponding to the gate signal line GLk is scanned, the polarity of the data signal DAT is inverted. That is, the polarity of the data signal DAT supplied to the pixel circuits PX included in the pixel line PL to be scanned is different from the polarity of the data signal DAT supplied to the pixel circuits PX included in the pixel line PL which is scanned one pixel line PL before. When the pixel line PL corresponding to the gate signal line GL(k+C) (where C is an integer equal to or greater than 0 and less than (A−1)) and then the pixel line PL corresponding to the gate signal line GL(k+C+1) is scanned, the polarity of the data signal DAT is not inverted.

Figure 5:
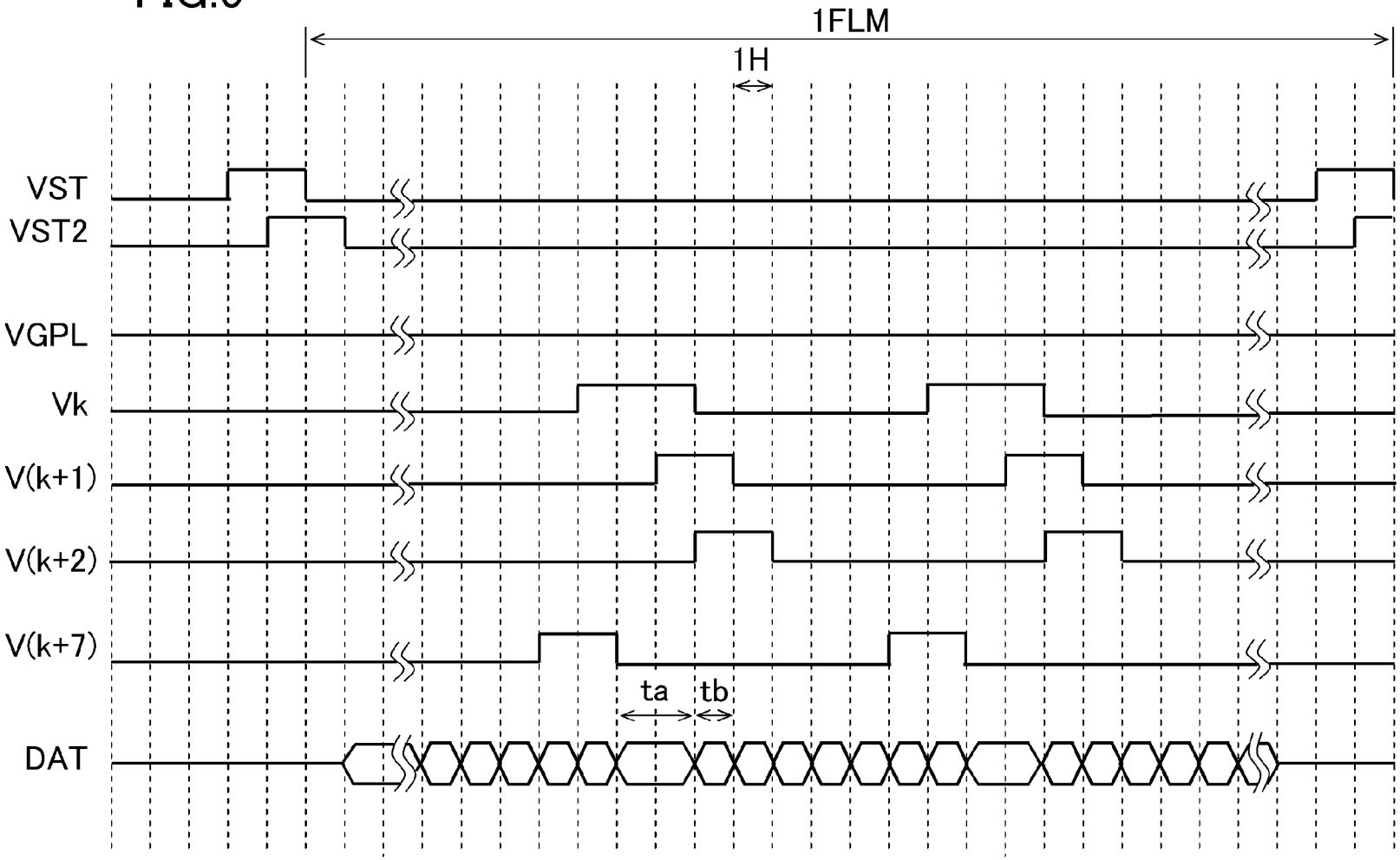
FIG. 5 is a waveform diagram illustrating examples of signals supplied from a control circuit in the first embodiment.

FIG. 5 is a waveform diagram illustrating examples of signals supplied from the control circuit DRV in the first embodiment. Sequentially from the upside, FIG. 5 shows the potential of the start signal line VST, the potential of the start signal line VST2, the potentials of the clock signal supplied to the input terminals Vk, V(k+1), V(k+2), and V(k+7) of the elementary circuit BC via the clock signal lines, and the potential of the data signal DAT supplied to the data signal line DL. The interval between the broken lines is one horizontal period (1H). Here, the period of time from the supply of the pulse signal with the start signal line VST to the next supply of the pulse signal with the start signal line VST is defined as one frame period (1FLM). The pulse signal has a potential (scanning potential) for turning on the pixel transistors TRP included in the pixel circuits PX included in the pixel line PL in the period where the pixel line PL is scanned, and has a higher potential than the reference potential in the example shown in FIG. 5 because the pixel transistors TRP are an n-channel type. The clock signal supply circuit repeatedly sequentially supplies the pulse signal to the clock signal lines V1 to V8 in each frame period.

Here, the period of the pulse signal which is output to an input terminal Vk from a clock signal line is longer than the period of the pulse signal which is output to the other input terminals V(k+1) and the like from the other clock signal lines. In the example shown in FIG. 5, the period of the pulse signal to the input terminal Vk is 3H and the period of the pulse signal to the other input terminals V(k+1) and the like is 2H. here, the pulse signal supplied to the input terminal Vy overlaps with the pulse signal supplied to the input terminal V(y−1) by one horizontal period of the head and overlaps with the pulse signal supplied to the input terminal V(y+1) by one horizontal period of the tail. In the period from the final time point of the pulse signal supplied to the input terminal V(y−1) to the final time point of the pulse signal supplied to the input terminal Vy, the control circuit DRV supplies the data signal DAT to the pixel circuits PX to be scanned by the pulse signal via the data signal lines DL.

Figure 6:
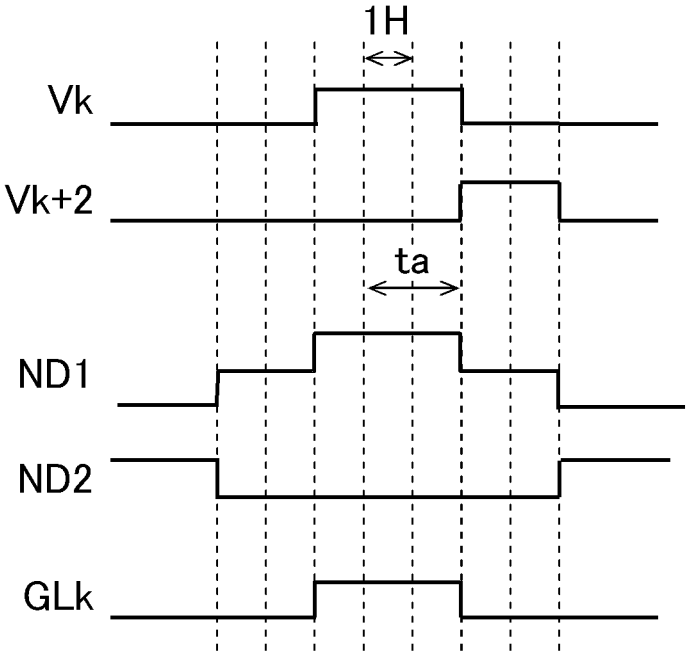
FIG. 6 is a waveform diagram illustrating examples of a clock signal supplied to a shift register circuit, potentials of node ND1 and node ND2, and a pulse signal to be output in the first embodiment.

The operation of the elementary circuit BCn shown in FIG. 3 in response to these signals will be described below. FIG. 6 is a waveform diagram illustrating examples of the clock signals supplied to the shift register circuits GDR and GDL, the potentials of the nodes ND1 and ND2, and the output pulse signal in the first embodiment. Hereinafter, it is assumed that n is equal to or more than 3 and less than (N+4). At the start point of the frame period, the potential of the node ND1 of the n-th elementary circuit BCn is the reference potential supplied from the reference potential supply line VGPL, that is, a potential for turning off the transistors T4 and T5 (hereinafter, the potential is referred to as "low"). The potential of the node ND2 is higher than the reference potential and is a potential for turning on the transistors T2 and T6 (hereinafter, the potential is referred to as "high"). In this state, the node ND1, the output terminal Gn, and the gate signal line GLn are supplied with the reference potential from the reference potential supply line VGPL and the elementary circuit BCn does not transmit the pulse signal from the input terminal Vn to the gate signal line GLn. Then, when the potential of the input terminal G(n−2) is changed to high by the output of the elementary circuit BC(n−2) two stages before, the transistor T7 is turned on, the potential of the node ND2 is changed to low, and the transistors T2 and T6 are turned off. A potential is supplied via the transistor T1, the node ND1 is changed to high, and the transistors T5 and T4 are turned on. The capacitor C1 stores the potential difference between the node ND1 and the source electrode of the transistor T5 and the potential of the node ND1 is maintained even when the input terminal G(n−2) is changed to low. When the pulse signal is supplied from the F(k)-th clock signal line via the input terminal Vk, the elementary circuit BCn transmits the pulse signal to the gate signal line GLn via the output terminal Gn. Here, during transmitting the pulse signal, the potential of the node ND1 becomes higher by the pulse signal due to the capacitor C1. In this state, the pixel line PL connected to the gate signal line GLn is scanned.

Then, when the output terminal G(n+4) is changed to higher by the output of the elementary circuit BC(n+4) four stages after, the transistor T9 is turned on, the transistor T9 resets the electric charge accumulated and the potential difference stored in the capacitor C1. Thus the node ND1 is changed to low. Accordingly, the transistor T5 and the transistor T4 are turned off. Almost at the same time, the pulse signal from the input terminal V(n+4) is supplied to the node ND2 via the transistor T3 and thus the node ND2 is changed to high. The capacitor C3 stores the potential difference between the reference potential supply line VGPL and the node ND2 and then maintains the potential of the node ND2. The transistors T2 and T6 are turned on and the potentials of the node ND1 and the gate signal line GLn are maintained as low.

In the example shown in FIG. 5 or 6, the data signal DAT supplied to the data signal line DL is supplied to the pixel circuits PX connected to the gate signal line GL(n−1) in one horizontal period of the head of the pulse signal to the gate signal line GLn and is also supplied to the pixel circuits PX connected to the gate signal line GL(n+1) in one horizontal period of the tail of the pulse signal. The pixel circuits PX connected to the gate signal line GLn is supplied with the data signal in the period other than one horizontal period of the head of the pulse signal. This is because the potential difference stored in the pixel capacitor CP included in pixel circuit PX is more dependent on the data signal DAT when the pixel transistor TRP included in the pixel circuit PX is changed to On to OFF. Therefore, a period to in which the data signal DAT is supplied to the gate signal line GLk is 2H and the period tb in which the data signal DAT is supplied to the gate signal line GL(k+1) and the like is 1H. As a result, the period of the pulse signal which is supplied to some gate signal lines GL is longer than the period of the pulse signal which is supplied to the other gate signal lines GL. The shift register circuits GDL and GDR are circuits that transmit the pulse signal supplied from the clock signal line in a frame period to the gate signal line GL in the predetermined order for the plural gate signal lines GL. Since the gate signal lines GL which transmits the pulse signal is determined in the order of the pulse signal, the period in which the pixel circuits PX are scanned can be changed by only changing the length of the pulse signal.

Here, in the above-mentioned example, the number of rows A by which the line inversion is performed is equal to the number of clock signal lines, but the number of rows A by which the line inversion is performed may be any number other than 1 of divisors of the number of clock signal lines. Then, since the clock signal line supplying the pulse signal longer than the other clock signals is fixed, the configuration of the clock signal supply circuit is simplified. As described above, when the long pulse signal has a period double longer than that of the short pulse signal, one horizontal period is a period which is a (A−1)/A multiple of one horizontal period in the case not employing the invention.

Regarding the elementary circuit shown in FIG. 3, the elementary circuit BC supplying a long pulse signal less affects the image quality even in a case that the change speed from the state where the pulse signal is not transmitted to the state where the pulse signal is transmitted is slightly lower than the other elementary circuits BC. Therefore, when the electrode width of the drain and source electrodes of the transistor T1 in the elementary circuit BC supplying the long pulse signal is Wt1*l* and the electrode width of the drain and source electrodes of the transistor T1 of the other elementary circuits BC is Wt1*s*, the electrode width Wt1*l* and the electrode width Wt1*s* may satisfy the relational expression Wt1*s*>Wt1*l*.

In the above-mentioned example, the writing to the pixel capacitor when the number N of pixel lines PL is 800, the driving frequency of a frame is 60 Hz, and the blanking period is 16H will be described below. The difference between the voltage applied to the data signal line DL and the voltage stored in the pixel capacitor CP in this embodiment is shown in Table 1.

TABLE 1

| Row | Time constant τ | Voltage (V) | Writing ratio | Differential voltage (mV) |
|---|---|---|---|---|
| Other than sA + 1 | 3.3 μs | 10 | 0.99998 | 0.13 |
| sA + 1 | 3.3 μs | 10 | 0.99998 | 0.17 |

Here, the time constant is determined by the capacitance and the ON-resistance of the pixel transistor TRP, the writing ratio represents a proportion of the voltage applied to the data signal line DL and the voltage stored in the pixel capacitor CP, and the differential voltage represents a difference between the voltage applied to the data signal line DL and the voltage stored in the pixel capacitor CP. In addition, s represents an integer of 0 to 100. Wt1*s* is 300 μm and Wt1*l* is 200 μm. On the other hand, the writing in the case not employing this embodiment is shown in Table 2.

TABLE 2

| Row | Time constant τ | Voltage (V) | Writing ratio | Differential voltage (mV) |
|---|---|---|---|---|
| Other than sA + 1 | 3.3 μs | 10 | 1.00000 | 0.03 |
| sA + 1 | 3.3 μs | 10 | 0.99795 | 20.55 |

As can be seen from the tables, according to this embodiment, the difference in differential voltage between the (sA+1)-th pixel line PL and the other pixel lines PL is greatly reduced and the unevenness in brightness due to the inversion of polarity is reduced.

The pixel transistors TRP may be a p-channel type. When high and low of the pulse signal supplied to the gate signal lines GL are exchanged, the same advantages can be achieved. The clock signal supply circuit and the shift register circuits GDR and GDL may be constructed in the same way.

Second Embodiment

A liquid crystal display device according to a second embodiment of the invention will be described below. The second embodiment is different from the first embodiment, in that the maximum or minimum potential is changed instead of the period of the pulse signal supplied from the clock signal supply circuit. The difference will be mainly described below.

Figure 7:
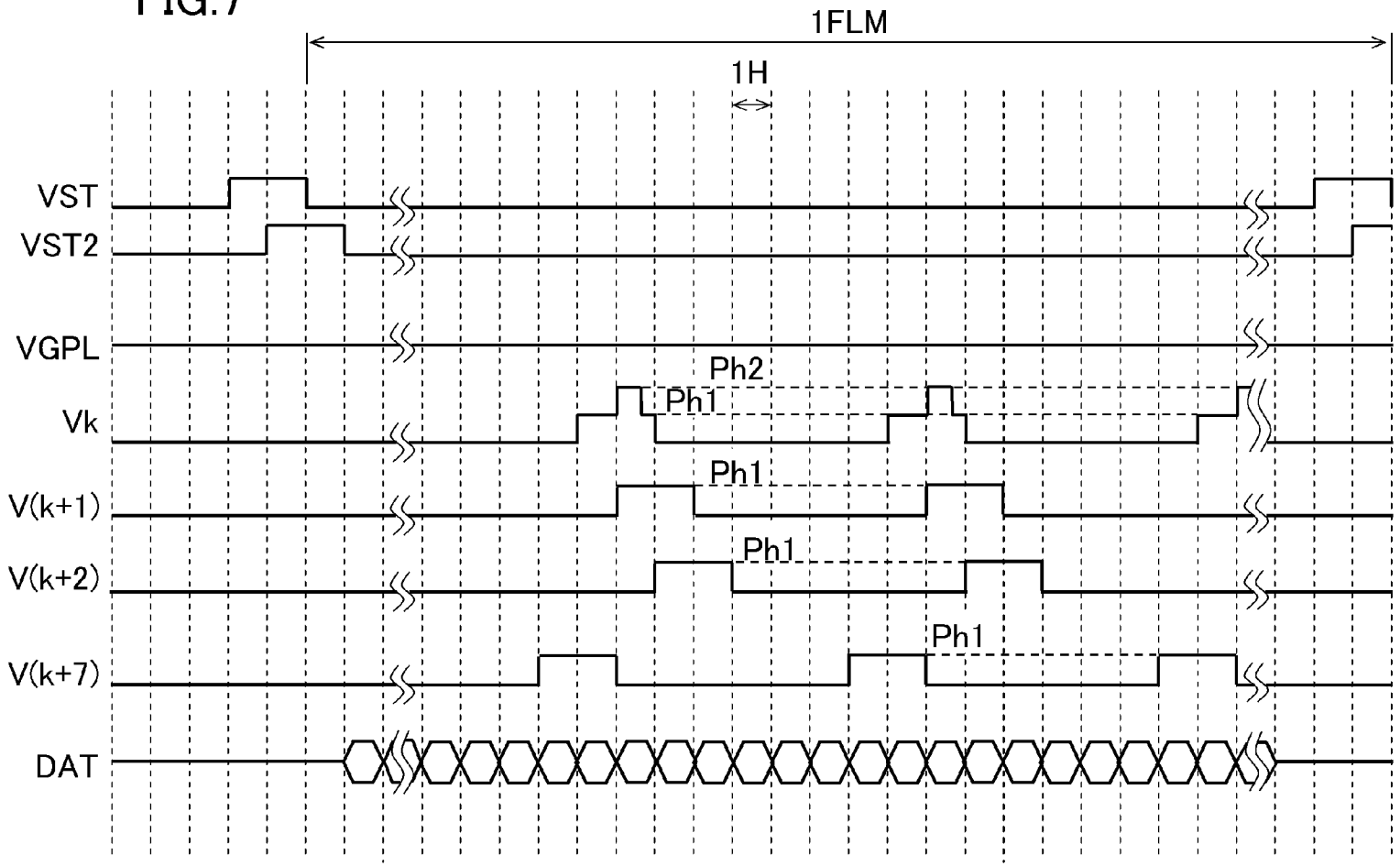
FIG. 7 is a waveform diagram illustrating examples of signals supplied from a control circuit in a second embodiment of the invention.

FIG. 7 is a waveform diagram illustrating examples of signals supplied from a control circuit in the second embodiment. FIG. 7 corresponds to FIG. 5 in the first embodiment. The period in which the pulse signal scans the pixel lines PL in FIG. 7 is constant in any pulse signal. However, the maximum potential of some pulse signals is higher than the maximum potential of the other pulse signals. In FIG. 7, the maximum potential of the pulse signal supplied from the F(k)-th clock signal line is higher than the maximum potential of the pulse signal supplied from the other clock signal lines.

Figure 8:
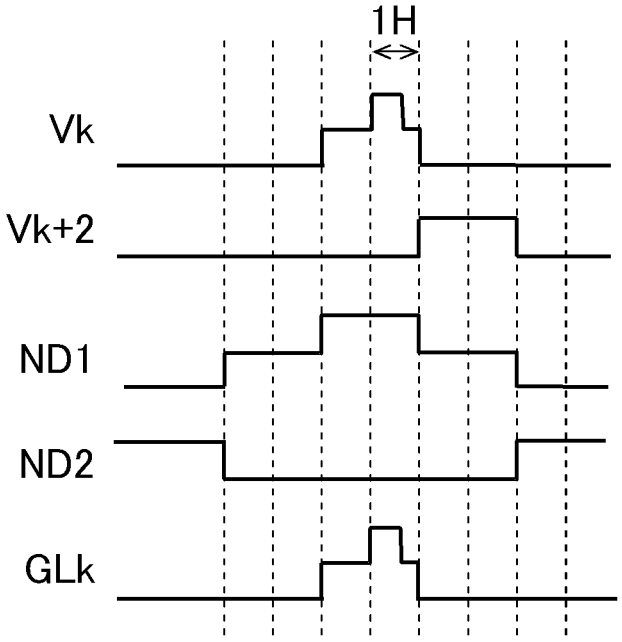
FIG. 8 is a waveform diagram illustrating examples of a clock signal supplied to a shift register circuit, potentials of node ND1 and node ND2, and a pulse signal to be output in the second embodiment.

FIG. 8 is a waveform diagram illustrating examples of clock signals supplied to the shift register circuits GDR and GDL, potentials of the nodes ND1 and ND2, and output pulse signal in the second embodiment. When the maximum potential of the pulse signal supplied from the F(k)-th clock signal line increases, the maximum potential of the pulse signal supplied to the pixel circuits PX connected to the gate signal line GLk also increases. This pulse signal enhances the transmissibility when the pixel transistor TRP included in the pixel circuits PX transmits the data signal DAT, compared with the pulse signal supplied from the other clock signal lines.

Figure 9:
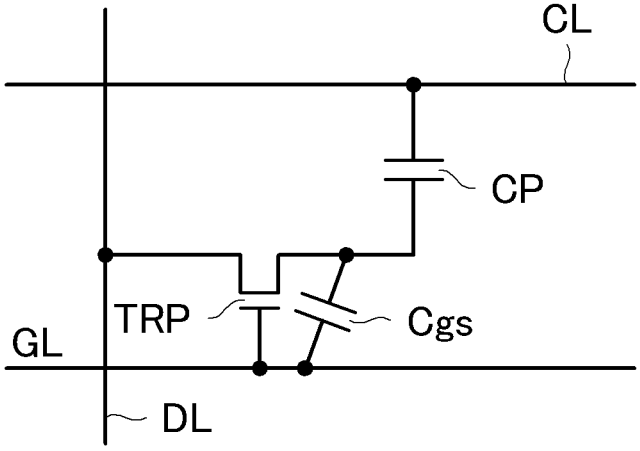
FIG. 9 is a diagram illustrating an example of a parasitic capacitance generated in a pixel circuit.

It is not always true that the potential of the pulse signal having the higher maximum potential is always higher than the potential of the other pulse signals. In at least the final predetermined period of the period of the pulse signal (the period in which the pixel line PL is scanned), any pulse signal may have the same potential. The final predetermined period is 10% of the period of the pulse signal in the example shown in FIG. 8. FIG. 9 is a diagram illustrating an example of a parasitic capacitance Cgs generated in the pixel circuit PX. In the actual pixel circuit PX, a parasitic capacitance Cgs is generated between the pixel electrode PT side of the pixel capacitor CP and the gate signal line GL. Since the parasitic capacitance Cgs is present, the potential difference stored in the pixel capacitor CP varies with the variation in potential of the gate signal line GL. By setting the potentials of the pulse signals to be the same as each other in the final predetermined period of the pulse signal, the variation in display gray level due to the difference in maximum potential between the gate signal lines GL is suppressed. In the examples shown in FIGS. 7 and 8, any pulse signal is set to have the same potential in the first horizontal period of the pulse signals.

In the above-mentioned example, the writing to the pixel capacitor when the number N of pixel lines PL is 800, the driving frequency of a frame is 60 Hz, and the blanking period is 16H will be described below. The difference between the voltage applied to the data signal line DL and the voltage stored in the pixel capacitor CP in this embodiment is shown in Table 3.

TABLE 3

| Row | Time constant τ | Voltage (V) | Writing ratio | Differential voltage (mV) |
|---|---|---|---|---|
| Other than sA + 1 | 3.3 μs | 10 | 1.00000 | 0.03 |
| sA + 1 | 1.7 μs | 10 | 1.00000 | 0.04 |

Here, the time constant is determined by the capacitance and the ON-resistance of the pixel transistor TRP, the writing ratio represents a proportion of the voltage applied to the data signal line DL and the voltage stored in the pixel capacitor CP, and the differential voltage represents a difference between the voltage applied to the data signal line DL and the voltage stored in the pixel capacitor CP. In addition, s represents an integer of 0 to 100. Wt1*s* and Wt1*l* are equal to each other. On the other hand, the writing in the case not employing this embodiment is shown in Table 4.

TABLE 4

| Row | Time constant τ | Voltage (V) | Writing ratio | Differential voltage (mV) |
|---|---|---|---|---|
| Other than sA + 1 | 3.3 μs | 10 | 1.00000 | 0.03 |
| sA + 1 | 3.3 μs | 10 | 0.99795 | 20.55 |

As can be seen from the tables, according to this embodiment, the difference in differential voltage between the (sA+1)-th pixel line PL and the other pixel lines PL is greatly reduced and the unevenness in brightness due to the inversion of polarity is reduced.

The pixel transistors TRP may be a p-channel type. When high and low of the pulse signal supplied to the gate signal lines GL are exchanged, the same advantages can be achieved. In this case, the minimum potential of the pulse signals supplied to the pixel circuits PX included in some pixel lines PL may be set to be smaller than the minimum potential of the pulse signals supplied to the pixel circuits PX included in the other pixel lines PL. The clock signal supply circuit and the shift register circuits GDR and GDL may be constructed in the same way.

The liquid crystal display devices according to the first and second embodiments of the invention are an IPS liquid crystal display device, where the common line CL is physically disposed on the array substrate. However, the invention may be applied to a TN liquid crystal display device. The difference with the TN liquid crystal display device is that an electrode corresponding to the common line is disposed on the counter substrate, but both have no difference in the method of controlling the gate signal lines GL.

While there have been described what are at present considered to be certain embodiments of the invention, it will be understood that various modifications may be made thereto, and it is intended that the appended claims coverall such modifications as fall within the true spirit and scope of the invention.

What is claimed is:

1. A display device comprising:

a plurality of pixel groups each including pixel circuits;

a plurality of scanning lines that are each disposed to correspond to any one of the plurality of pixel groups and that are connected to the pixel circuits included in the corresponding pixel group;

a clock signal supply circuit that supplies a clock signal including a pulse signal as a potential scanning the corresponding pixel group in a period in which each of the plurality of pixel groups is scanned;

a shift register circuit that selectively transmits the pulse signal to the plurality of scanning lines in a predetermined order; and data signal lines that are connected to the pixel circuits included in the plurality of pixel groups and that supply a data signal to the pixel circuits included in the pixel group to be scanned;

wherein the clock signal supply circuit supplies the clock signal so that a period of the pulse signal supplied to some of the plurality of scanning lines is longer than a period of the pulse signal supplied to the other scanning lines;

wherein the shift register circuit includes a plurality of elementary circuits that transmit the pulse signal from the clock signal supply circuit to any of the plurality of scanning lines;

wherein each elementary circuit includes:

a first transistor that is disposed between the clock signal line and the corresponding scanning line; and a second transistor that is diode-connected and that supplies the pulse signal to be output to the scanning line in a predetermined number before the corresponding scanning line to a gate electrode of the first transistor; and wherein a width of a source electrode and a drain electrode of the second transistor included in an elementary circuit in which the period in which the supplied pulse signal serves as a scanning potential is long is smaller than a width of a source electrode and a drain electrode of the second transistor included in an other elementary circuit.

2. The display device according to claim 1, wherein the clock signal supply circuit supplies the clock signal so that the period of the pulse signal supplied to the pixel group to be scanned in a case that the polarity of the data signal supplied to the pixel circuits included in the pixel group to be scanned is different from the polarity of the data signal supplied to the pixel circuits included in the pixel group which is scanned just before the pixel group to be scanned is longer than a case in which the polarities of the two data signals are not different from each other.

3. The display device according to claim 2, further comprising:

a plurality of clock signal lines that supply the clock signal from the clock signal supply circuit to the shift register circuit, wherein the clock signal supply circuit repeatedly supplies the pulse signal to the plurality of clock signal lines sequentially from the first clock signal line, and wherein the data signal lines supply the data signal changed in polarity every selection of predetermined number of the pixel groups, and the predetermined number of the pixel groups is any one of divisors other than 1 of the number of clock signal lines.

4. The display device according to claim 1, wherein each elementary circuit further includes:

a capacitor that stores a potential difference generated due to the potential of the pulse signal supplied from the second transistor and that turns on the first transistor until the potential difference is reset; and a third transistor that resets the potential difference stored in the capacitor on the basis of the pulse signal output to the scanning line in a predetermined number after the scanning line to which the elementary circuit transmits the pulse signal.

* * * * *